US006169464B1

(12) United States Patent
Moon et al.

(10) Patent No.: US 6,169,464 B1
(45) Date of Patent: Jan. 2, 2001

(54) DIELECTRIC FILTER

(75) Inventors: Myoung Lib Moon; Jong Soo Ha, both of Seoul (KR)

(73) Assignee: Samsung Electro-Mechanics Co., Ltd., Kyungki-do (KR)

( * ) Notice: Under 35 U.S.C. 154(b), the term of this patent shall be extended for 0 days.

(21) Appl. No.: 09/209,710

(22) Filed: Dec. 11, 1998

Related U.S. Application Data

(60) Provisional application No. 60/106,901, filed on Nov. 3, 1998.

(51) Int. Cl.[7] ..... H01P 1/20; H01P 7/04; H01P 5/12

(52) U.S. Cl. ..... 333/206; 333/207; 333/223; 333/134

(58) Field of Search ..... 333/202, 206, 333/207, 222, 223, 134

(56) References Cited

U.S. PATENT DOCUMENTS

| | | | | |
|---|---|---|---|---|
| 4,716,391 | | 12/1987 | Moutrie et al. . | |
| 4,742,562 | | 5/1988 | Kommrusch . | |
| 4,879,533 | | 11/1989 | de Muro et al. . | |
| 5,004,992 | * | 4/1991 | Grieco et al. | 333/202 |
| 5,230,093 | * | 7/1993 | Rich et al. | 333/202 |
| 5,537,082 | | 7/1996 | Tada et al. . | |
| 5,537,085 | | 7/1996 | McVeety . | |
| 5,859,575 | * | 1/1999 | Hino | 333/206 |
| 5,945,895 | * | 8/1999 | Ono | 333/207 |

FOREIGN PATENT DOCUMENTS

| | | |
|---|---|---|
| 0 442 418 | 2/1991 | (EP) . |
| 0 757 401 | 2/1997 | (EP) . |
| 0 759 643 | 2/1997 | (EP) . |
| 0 798 803 | 10/1997 | (EP) . |
| 0 840 390 | 5/1998 | (EP) . |
| 2 261 325 | 5/1993 | (GB) . |
| 5-130141 | 11/1976 | (JP) . |
| 52-96846 | 8/1977 | (JP) . |
| 8-88504 | 4/1996 | (JP) . |
| 10051206 | 2/1998 | (JP) . |
| 10065404 | 3/1998 | (JP) . |
| 10-107502 | 4/1998 | (JP) . |
| 10-98305 | 4/1998 | (JP) . |
| 10-270907 | 10/1998 | (JP) . |
| 10-270908 | 10/1998 | (JP) . |

* cited by examiner

*Primary Examiner*—Robert Pascal
*Assistant Examiner*—Patricia T. Nguyen
(74) *Attorney, Agent, or Firm*—Renner, Otto, Boisselle & Sklar LLP

(57) ABSTRACT

A dielectric filter is disclosed in which an open area without being spread with a conductive material is formed on the rear face of a dielectric block with a conductive material spread thereon, thereby making it possible to improve the filtering characteristics of the filter and to miniaturize the filter. That is, coupling capacitances and coupling inductances are formed between resonance holes of the rear face of the dielectric block. Further, conductor patterns are formed on the front face of the dielectric block so that coupling capacitances are formed between the resonance holes of the front face, and that loading capacitances are provided to the respective resonance holes.

30 Claims, 14 Drawing Sheets

DIELECTRIC FILTER

This Application claims benefit to provisional Application 60/106,901 filed Nov. 3, 1998.

BACKGROUND OF THE INVENTION

1. Field of the Invention

The present invention relates to a dielectric filter. Particularly, the present invention relates to a dielectric filter in which an open area without being spread with a conductive material is formed on the rear face of a dielectric block with a conductive material spread thereon, thereby making it possible to improve the filtering characteristics of the filter and to miniaturize the filter.

2. Description of the Prior Art

Recently, the mobile communication system using the radio frequency (RF) band is replacing the wired communication system. Accordingly, the demand for the mobile communication apparatuses is being greatly increased, and studies on them are being briskly carried out. The special feature of the mobile communication system is that the user carries the terminal anywhere. Therefore, it is required that the performance of the mobile communication apparatus has to be improved, and that a miniaturization and light weight have to be achieved.

As described above, in order to simultaneously achieve the improvement of the performance and the compactness and light weight, every component of the mobile communication apparatus has to be miniaturized. For this purpose, a unitized dielectric filter is widely used. Generally, in the dielectric filter, there are connected a plurality of dielectric blocks with a coaxial resonator provided on each of them, thereby obtaining the desired pass band characteristics of the RF band. In the unitized dielectric filter, a plurality of coaxial resonators are formed to a single dielectric block, thereby obtaining the pass band characteristics. This unitized dielectric filter is provided at both the receiving part and the transmitting part, so that the transmitted and received radio waves can be filtered. The required pass band is about 20–30 MHz.

FIG. 1 is a perspective view of the conventional unitized dielectric filter. As shown in the drawing, the dielectric filter includes: a first face 5 and a second face 7 oppositely facing from each other; and a hexahedral dielectric block 1 having side faces between the first and second faces 5 and 7. Within the dielectric block 1, there are a plurality of resonance holes 3 disposed in parallel with each other and passing through the first and second faces 5 and 7. The side faces which lie between the first and second faces 5 and 7 are coated with a conductive material to form a ground electrode. The first face 5 of the dielectric block 1 forms an open area not coated with a conductive material. Further, the insides of the resonance holes 3 are coated with a conductive material to form internal electrodes.

Around each of the resonance holes 3 of the first face 5, there is formed a conductor pattern 8 having a certain width. The conductor pattern 8 is connected to the internal electrode of the resonance hole 3 to form a loading capacitance and a coupling capacitance. The resonance frequency of the resonator is decided by the resonance hole 3 and by the loading capacitance, while the coupling capacitance couples the two resonators together. Further, the side faces which lie between the first face 5 and the second face 7 are provided with input/output terminals 12*a* and 12*b*.

In the above described filter, the filtering characteristics become different in accordance with the coupling capacitance and the resonance frequency of the resonator which are decided by the loading capacitance and the resonance hole 3. Therefore, the filtering characteristics are decided by the size of the conductor pattern 8 which forms the loading capacitance and the coupling capacitance. The loading capacitance is dominantly decided by the distance between the side face of the dielectric block 1 and the conductor pattern 8 of the first face 5. Therefore, in order to adjust the filtering characteristics of the unitized dielectric filter, the gap between the ground electrode and the conductor pattern 8 and the gap between the adjacent conductor patterns 8 have to be adjusted by adjusting the size of the conductor pattern 8.

However, the size of the mobile communication apparatus has to be reduced to the minimum for its carrying convenience. Therefore, the dielectric filter also have to be miniaturized as far as possible. For this, the bulk of the dielectric block 1 has to be reduced. In order to reduce the bulk, the distance between the resonance holes 3 and between the holes 3 and the side face has to be reduced, but this means that the area of the first face 5 has to be reduced.

Therefore, the conductor pattern 8 of the first face 5 has to be reduced. If the size of the conductor pattern 8 is reduced, it is difficult to manufacture the filter having the required filtering characteristics. Further, in order to miniaturize the dielectric filter, the gap between the conductor patterns 8 has to be reduced. Generally, the ground electrode and the conductor pattern 8 of the first face 5 are formed by a screen printing process. This screen printing process shows an error range of 25–30 $\mu$m in its line width. Therefore, in the case where the conductor patterns 8 are formed around two resonance holes 3 to form a miniaturized filter, the reduction of the size of the conductor pattern 8 and of the gap between the conductor pattern 8 and the ground electrode encounters a limit, and therefore, the desired magnitude of the loading capacitance cannot be achieved. Further, in the case where the gap between the conductor patterns 8 is made small by the reduction of the area of the first face 5, the conductor patterns 8 can be short-circuited due to the errors of the screen printing process.

FIG. 2 is a perspective view showing a duplex dielectric filter for filtering the transceiving signals of the mobile communication apparatus. Like the unitized dielectric filter, the duplex dielectric filter includes: first and second faces 5 and 7; and a hexahedral dielectric block 1 having side faces between the first and second faces 5 and 7. Within the dielectric block 1, there are a plurality of resonance holes 3 disposed in parallel with each other and passing through the first and second faces 5 and 7. On the second face 7 and the side faces, there are coated ground electrodes (not shown in the drawing). Further, an internal electrode is formed on the inside of the resonance hole 3 so as to form a resonator. Further, an open area is formed on the second face 7, without being coated with a conductive material.

Around each of the resonance holes 3 of the first face 5, there is formed a conductor pattern 8 having a certain width. A loading capacitance is formed between the ground electrode and the conductor pattern 8, while a coupling capacitance is formed between the conductor patterns of the adjacent resonance holes 3. Further, the first face 5 is provided with an antenna terminal 13 and reception and transmission terminals 12*a* and 12*b*.

In the duplex dielectric filter of the drawing, the three resonance holes of the left part of the first face 5 are receiving ends for receiving RF signals from the external, while the four resonance holes of the right part are transmitting ends for transmitting RF signals to the outside. Under this condition, the respective resonance holes 3 form resonators and form the loading capacitances.

Generally, in the duplex dielectric filter, the RF band of the transmitting terminals is lower than the RF band of the receiving terminals. Therefore, an electric field effect is dominant between the resonance holes 3 of the receiving terminals, while a magnetic field effect is dominant between the resonance holes 3 of the transmitting terminals. Therefore, the resonators of the receiving terminals form a capacitance coupling, while the resonators of the transmitting terminals form an inductance coupling.

In the duplex dielectric filter like in the dielectric filter of FIG. 1, the coupling between the resonators and the decision of the resonance frequency becomes different depending on the size of the conductor patterns 8 of the first face 5. That is, the characteristics of the duplex dielectric filter become different depending on the gap between the conductor pattern 8 and the ground electrode and on the gap between the conductor patterns 8. However, like in the dielectric filter of FIG. 1, in order to form a miniaturized filter, the thickness of the dielectric block 1 has to be thin, and the gaps between the resonance holes 3 have to be made narrow. However, in such a miniaturized filter, the area of the first face 5 is reduced, and therefore, the reduction of the gap between the conductor pattern 8 and the reduction of the gaps between the adjacent conductor patterns 8 encounter a limit, thereby making impossible to obtain the desired filtering characteristics.

SUMMARY OF THE INVENTION

The present invention is intended to overcome the above described disadvantages of the conventional techniques.

Therefore it is an object of the present invention to provide a dielectric filter in which an open area is formed on the rear face of the dielectric block having a ground electrode, so as to form a coupling capacitance and a coupling inductance, thereby making it possible to manufacture a miniaturized filter and to easily control the filter characteristics.

It is another object of the present invention to provide a duplex dielectric filter in which an open area is formed on the rear face of the dielectric block having a ground electrode, so as to form a coupling capacitance and a coupling inductance, thereby making it possible to manufacture a miniaturized filter and to easily control the filter characteristics.

In achieving the above objects, in a first aspect of the present invention, the dielectric filter according to the present invention includes: a dielectric block having first and second faces and side faces between the first and second faces, the second face and the side faces being coated with a conductive material; a plurality of resonance holes passing through the first and second faces in parallel with each other, with insides of the holes being coated with a conductive material; input and output pads, each of them consisting of an isolated electrode and the conductive material of the side faces of the dielectric block, for forming an electromagnetic coupling with the resonance hole; and at least one open area without being coated with a conductive material, and formed on the second face of the dielectric block to form an electromagnetic coupling with adjacent resonators.

The open area includes: at least a first area formed above or below the plurality of first resonance holes along an arrangement direction of the resonance holes; and at least a second area formed in an opposite side of the plurality of second resonance holes along the arrangement direction of the resonance holes. The first and second areas are for forming a coupling inductance with adjacent resonators, and they can be separately formed on the second face. Further, an open area for adjusting a resonance frequency of the resonator is formed on the second face. The open area for adjusting the resonance frequency is formed between an end of the resonance hole and the side face of the dielectric block, to make it possible to adjust the resonance frequency to a desired level.

A plurality of conductor patterns are formed on the first face of the dielectric block to add an additional inductance to the resonators, and to form a coupling capacitance with adjacent resonators. Further, a conductor pattern extending from the conductive material of the side face toward an end of the resonance hole is a means for adjusting the resonance frequency of the resonator, and the resonance frequency is adjusted by adjusting the area of the conductor pattern or the gap between the conductor pattern and the end of the resonance hole.

In another aspect of the present invention, the duplex dielectric filter according to the present invention includes: a dielectric block having first and second faces and side faces between the first and second faces, the second face and the side faces being coated with a conductive material; a first filtering region consisting of at least one resonator having a plurality of resonance holes passing through the first and second faces of the dielectric block in parallel with each other, with insides of the holes being coated with a conductive material, for filtering first input signals; a second filtering region consisting of at least one resonator having a plurality of resonance holes passing through the first and second faces of the dielectric block in parallel with each other, with insides of the holes being coated with a conductive material, for filtering second input signals; input and output pads, each of these consisting of an isolated electrode and the conductive material of the side faces of the dielectric block, for forming an electromagnetic coupling with the resonance hole; and at least one open area without being coated with a conductive material, and formed on the first filtering region of the second face of the dielectric block to form an electromagnetic coupling with adjacent resonators.

The open area includes: at least a first area formed above or below the plurality of first group of resonance holes along an arrangement direction of the resonance holes; and at least a second area formed in another group of the plurality of second resonance holes along the arrangement direction of the resonance holes. The first and second areas are for forming a coupling inductance between adjacent resonators, and they can be separately formed on the second face. Further, an open area for adjusting the resonance frequency of the resonator is formed on the second face. The open area for adjusting the resonance frequency is formed between an end of the resonance hole and the side face of the dielectric block, to make it possible to adjust the resonance frequency to a desired level.

A plurality of conductor patterns are formed on the first face of the dielectric block to add an additional inductance to the resonators, and to form a coupling capacitance with adjacent resonators. Further, the conductor pattern is a means for adjusting a resonance frequency of the resonator, and it extends from the conductive material of the side face toward an end of the resonance hole. The resonance frequency is adjusted by adjusting the area of the conductor pattern or the gap between the conductor pattern and the end of the resonance hole.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENTS

In order to finely adjust the frequency band of a unitized dielectric filter or a duplex dielectric filter, the gap between the ground electrode of the side face of the dielectric block and the conductor pattern of the front face of the dielectric block (connected to the internal electrode formed within resonance holes) has to be adjusted. However, in a miniaturized dielectric filter, the size of the dielectric block and the areas of the front and rear faces are reduced, and therefore, conventionally there has been a limit in adjusting the size of the conductor pattern which is connected to the internal electrode of the resonance hole. Therefore, in the present invention, the size of the dielectric block is more reduced compared with the conventional ones, and the conductor patterns which are connected to the internal electrodes of the resonance holes are formed on the front face in a reduced size compared with the conventional ones. Further, an inductance adjusting section is formed on the rear face. Thus a miniaturized light-weight dielectric filter is realized.

Further, in a dielectric filter or in a duplex dielectric filter in which 3 or more resonance holes are formed, an inductance adjusting section and a capacitance adjusting section are formed on the rear face of the dielectric block. In this manner, not only a coupling inductance and a coupling capacitance but also a cross coupling inductance with non-adjacent resonators are formed, thereby controlling the filter characteristics.

These adjusting sections include: a first adjusting section for deciding the size of the coupling inductance and for forming the cross coupling inductance; and a second adjusting section (a resonance frequency tuning section) for finely adjusting the size of the loading capacitance.

Figure 1:
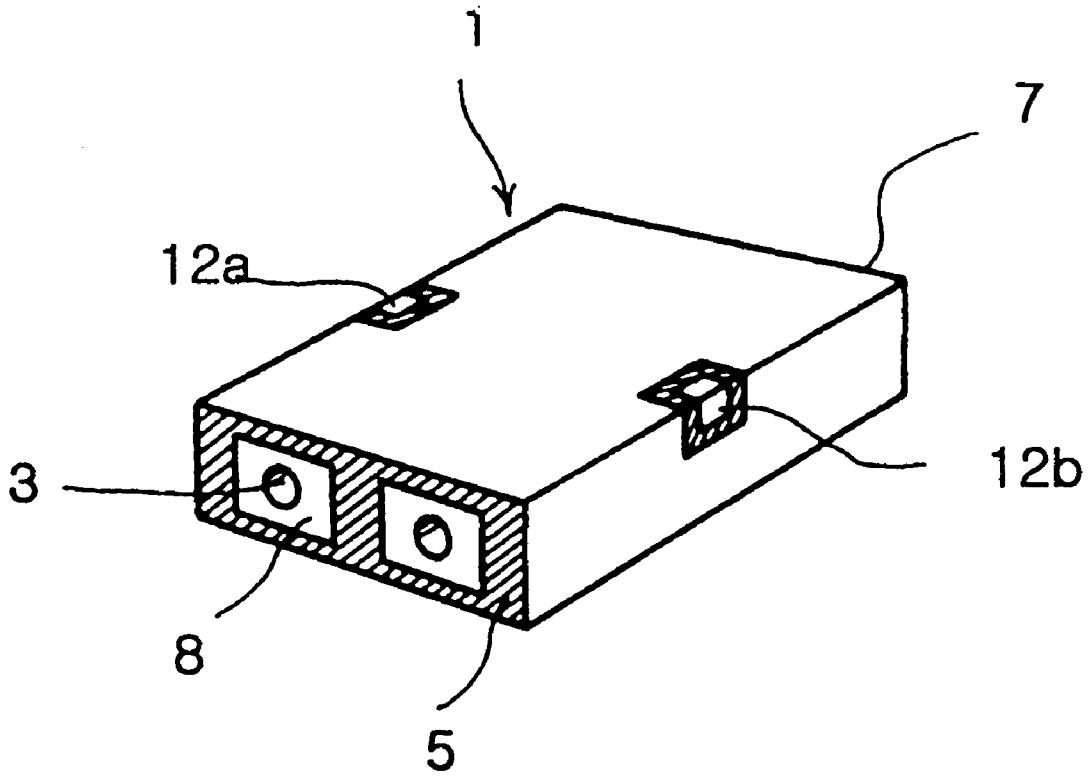
FIG. 1 PRIOR ART
FIG. 1 is a perspective view of the conventional unitized dielectric filter.
Figure 2:
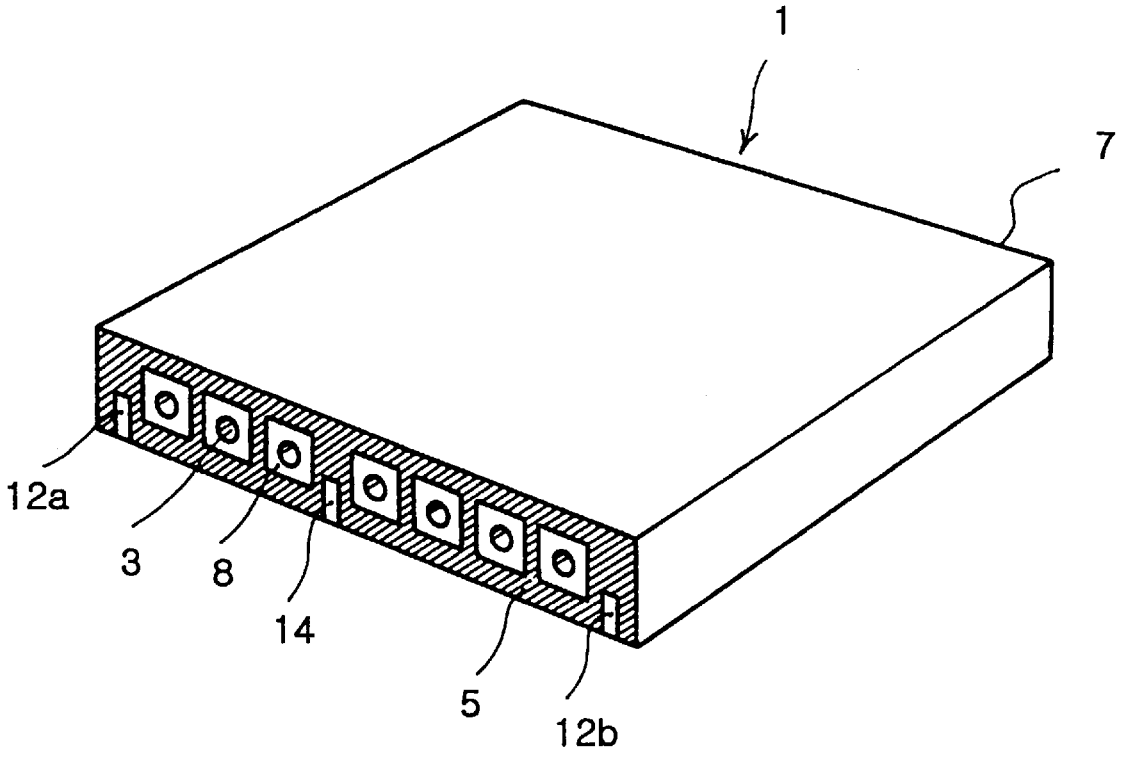
FIG. 2 PRIOR ART
FIG. 2 is a perspective view showing a conventional duplex dielectric filter for filtering the transceiving signals of the mobile communication apparatus.
Figure 3:
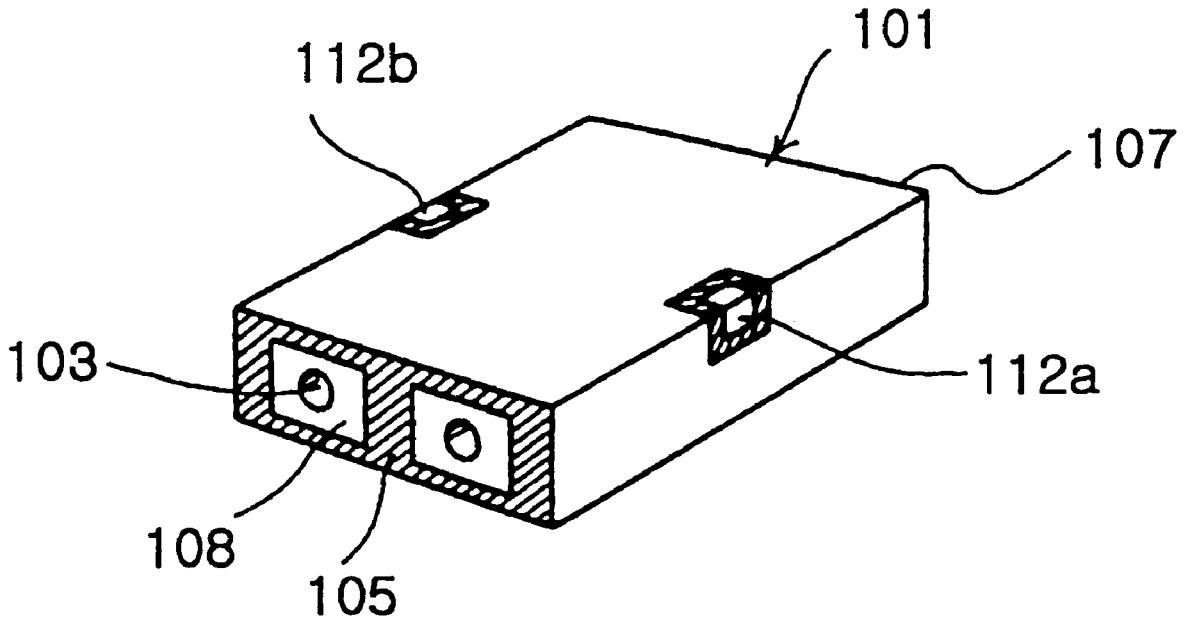
FIG. 3 is a perspective view of an embodiment of the unitized dielectric filter according to the present invention.

FIG. 3 is a perspective view of an embodiment of the unitized dielectric filter according to the present invention. FIG. 4 illustrates the second face, i.e., the rear face of the filter of FIG. 3. FIG. 5 illustrates the first face, i.e., the front face of the filter of FIG. 3.

As shown in FIG. 3, the unitized dielectric filter according to the present invention has oppositely facing first and second faces 105 and 107, and forms an approximately hexahedral shape. The second face 107 and side faces between the first and second faces 105 and 107 are coated with a conductive material to form a ground electrode. Within the dielectric block, there are formed two resonance holes 103, and these holes 103 pass through the first and second faces 105 and 107 in parallel with each other, to form resonators. Although not illustrated in the drawings, the insides of the resonance holes 103 are coated with a conductive material to form internal electrodes.

The first face 105, i.e., the front face of the dielectric block is an open area without being coated with a conductive material. There is formed a conductor pattern 108 around each of the resonance holes 103. A loading capacitance is formed between the conductor pattern 108 and the ground electrode to decide the resonance frequency. A coupling capacitance is formed between the conductor patterns 108 to decide the band width of the filter.

As shown in FIG. 4, on the second face 107, i.e., the rear face of the dielectric block, there is formed at least one open area 120 separated from the resonance holes 103, the open area 120 not being coated with a conductive material. When forming the open area 120, a mask is used when the conductive material is spread by applying a screen printing process, so that the relevant area would be shielded, thereby forming the open area 120. That is, when the conductive material is spread, the open area 120 can be formed simultaneously.

Figure 4A:
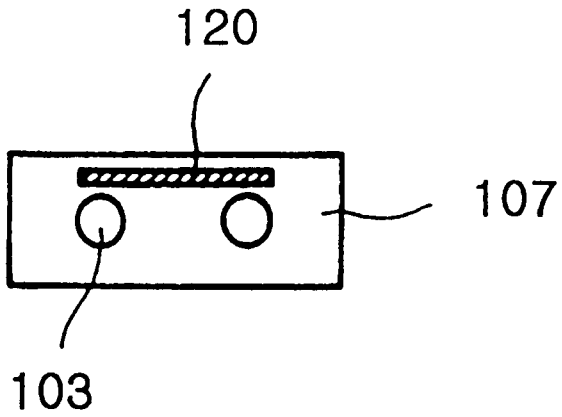
FIG. 4 illustrates the second face of the filter of FIG. 3
Figure 4B:
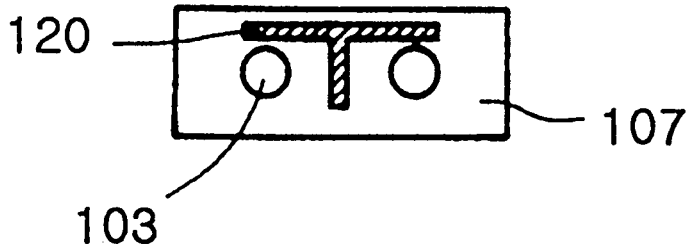

FIGS. 4A–4B illustrate examples of the open area.

Figure 4C:
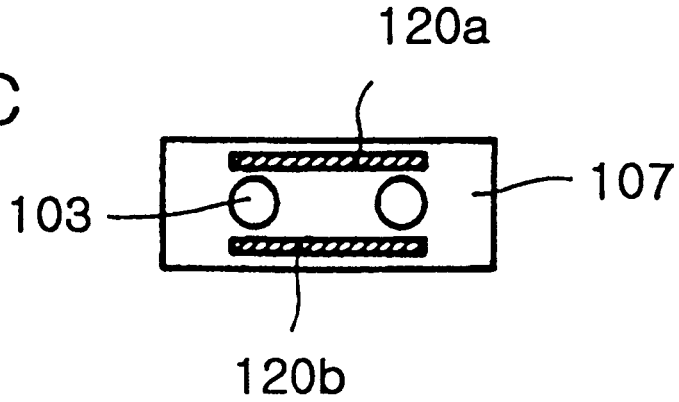
Figure 4D:
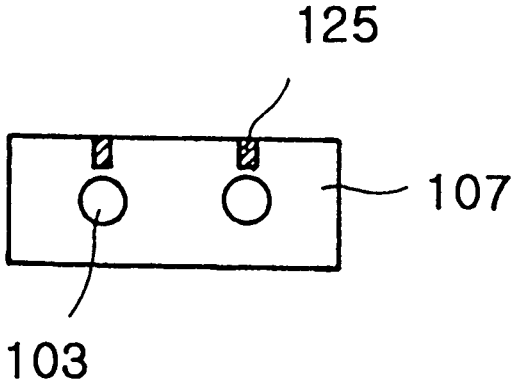

Referring to FIG. 4A, the open area 120 is formed in parallel with the arrangement direction of the resonance holes 103. Referring to FIG. 4B, the open area 120 is formed in parallel with the arrangement direction of the resonance holes 103, but the open area protrudes into between the resonance holes 103 in a T shape. Referring to FIG. 4C, two open areas 120 are formed in parallel with the arrangement direction of the resonance holes, 103 above and below the resonance holes 103. Referring to FIG. 4D, two frequency adjusting open areas 125 are formed respectively above the resonance holes 103 in a short form.

Figure 6:
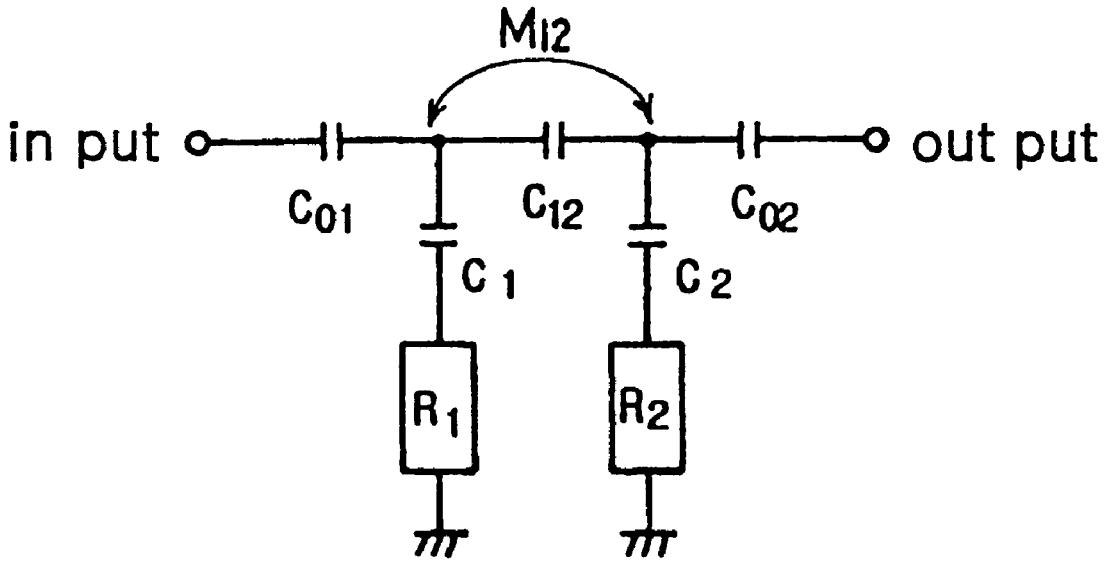
FIG. 6 is an equivalent circuit diagram for the unitized dielectric filter of FIG. 3.

FIG. 6 is an equivalent circuit diagram for the unitized dielectric filter of FIG. 3. In the drawing, reference codes R1 and R2 indicate resonators respectively, and $C_{01}$ and $C_{02}$ indicate coupling capacitors formed between input and output terminals 112*a* and 112*b*. Reference code $C_{12}$ indicates a coupling capacitance between the resonators R1 and R2, and M12 indicates a coupling inductance between the resonators R1 and R2. The coupling capacitance $C_{12}$ is formed between the conductor patterns 108 which are formed on the first face 105 of the dielectric block 101. The coupling inductance $M_{12}$ is formed by the open area 120 of the second face 107. In this equivalent circuit, if input signals are inputted into the input terminal 112*b*, then electric fields are established in the two resonance holes 103, with the result that the resonators are activated. Under this condition, owing to the open area 120 of the second face 107, the coupling inductance $M_{12}$ increases more than the case where the open area 120 lacks. The rate of the increase of the coupling inductance $M_{12}$ is adjusted by varying the length and width of the open area 120. If the length and width of the open area 120 are increased, the coupling inductance increases.

If the open area 120 is formed between the resonance holes 103 as shown in FIG. 4*b*, the open area 120 causes the coupling inductance $M_{12}$ between the two resonance holes 103 to be increased, thereby improving the characteristics of the dielectric filter.

That is, in addition to the coupling capacitance $C_{12}$ between the conductor patterns 108, there is present the coupling inductance $M_{12}$ owing to the open area 120. Therefore, by adjusting the length and width of the open area 120, the magnitude of the coupling inductance $M_{12}$ can be controlled, and therefore, the controls of the capacitance and inductance are rendered possible which have been impossible in the conventional filters.

Meanwhile, the open areas 125 of FIG. 4D are for finely adjusting the resonance frequency. Like in FIGS. 4A to 4C, these open areas 125 are formed during the spreading of the conductive material simultaneously by using a mask. In the drawing, the open areas 125 are formed only above the resonance holes 103, but their positions are not limited to that of the drawing. That is, they can be formed below the resonance holes 103, or they can be formed at sides of the resonance holes 103. Here, the tuning open areas 125 may be connected to the internal electrodes of the resonance holes 103, but they may be isolated from the internal electrodes, so that they would extend along the side faces of the dielectric block 101. Further, they may be connected to the side ground electrodes.

In the case of the open area 120 of FIG. 4*a* also, its position is not limited to that of the drawing, but it may be disposed below the resonance holes 103.

That is, the examples of FIGS. 4A to 4D are not limited to those illustrated in the drawings. That is, the frequency adjusting open areas of FIG. 4D may be independently formed, or they may be formed simultaneously with those of FIGS. 4*a* to 4*c*.

FIGS. 5A to 5D are examples of the structures of the first face of the dielectric filter of FIG. 3. These structures can be varied into numerous examples by combining with the structures of the second face of FIGS. 4A to 4D.

The structures of FIG. 5 will be reviewed. Referring to FIG. 5A, a conductor pattern 130 of a certain width is formed in parallel with the arrangement direction of the resonance holes 103 of the first face 105 above them. The conductor pattern 130 maintains a certain distance from the resonance holes 103 to form a coupling capacitance with the adjacent resonator, thereby making it possible to control the characteristics of the dielectric filter. Under this condition, the conductor pattern 130 may be formed above or below the resonance holes 103 or above and below them.

Figure 5A:
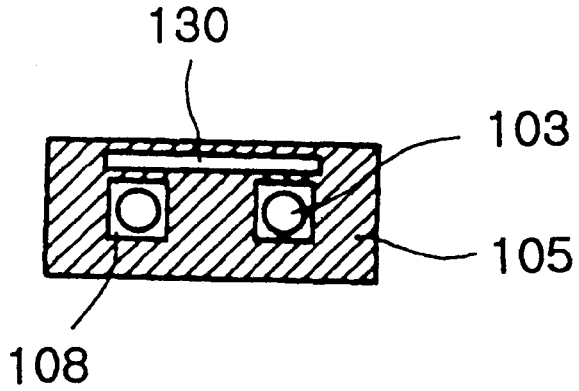
FIG. 5 illustrates the first face of the filter of FIG. 3.
Figure 5B:
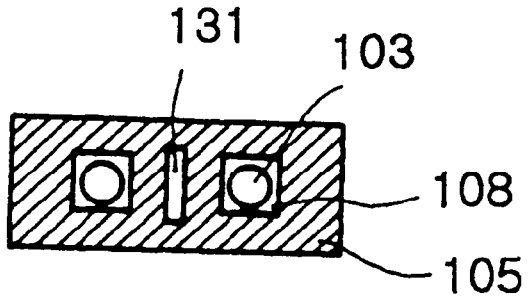
Figure 5C:
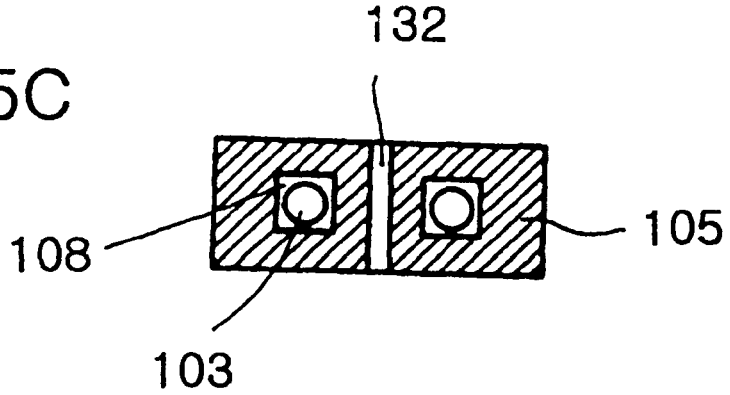
Figure 5D:
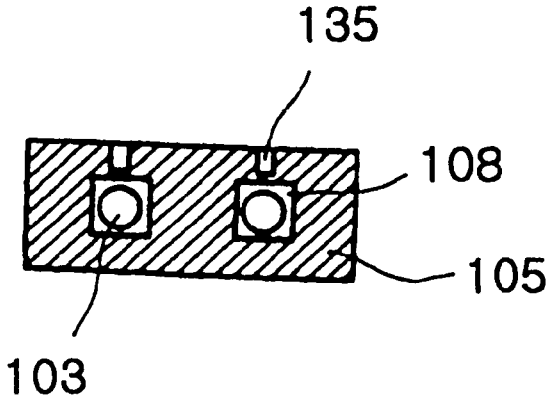

Referring to FIG. 5B, there is formed a conductor pattern 131 between the resonance holes 103. The conductor pattern 131 forms coupling capacitances with respective resonators to provide a new coupling capacitance to the whole dielectric filter. The conductor pattern 132 of FIG. 5C is connected to the ground electrodes of the dielectric block. In FIG. 5D, there are illustrated resonance frequency adjusting conductor patterns 135 like in FIG. 4D. The resonance frequency is adjusted by varying the total areas of the conductor patterns 135, or by varying their distance from the resonance holes 103. Here also, their structures are not limited to those illustrated in the drawing That is, they may be formed above or below the resonance holes 103, or they may be formed at sides of the resonance holes 103. Further, they may be connected or isolated to or from the ground electrodes of the side faces. Although the conductor patterns 135 may be connected to the conductor patterns 108, they should be preferably separated from each other.

In the present invention as described above, the damping ratio of the damping point can be controlled by forming an open area 120 on the second face 107, i.e., on the rear face of the dielectric filter, and therefore, the filter characteristics can be easily controlled. Further, a plurality of the conductor patterns are formed in a small size on the first face 105 of the dielectric block to control the capacitance and inductance of the dielectric filter. Therefore, not only a miniaturization is possible compared with the conventional ones, but also the defects due to the printing errors can be eliminated.

Figure 7:
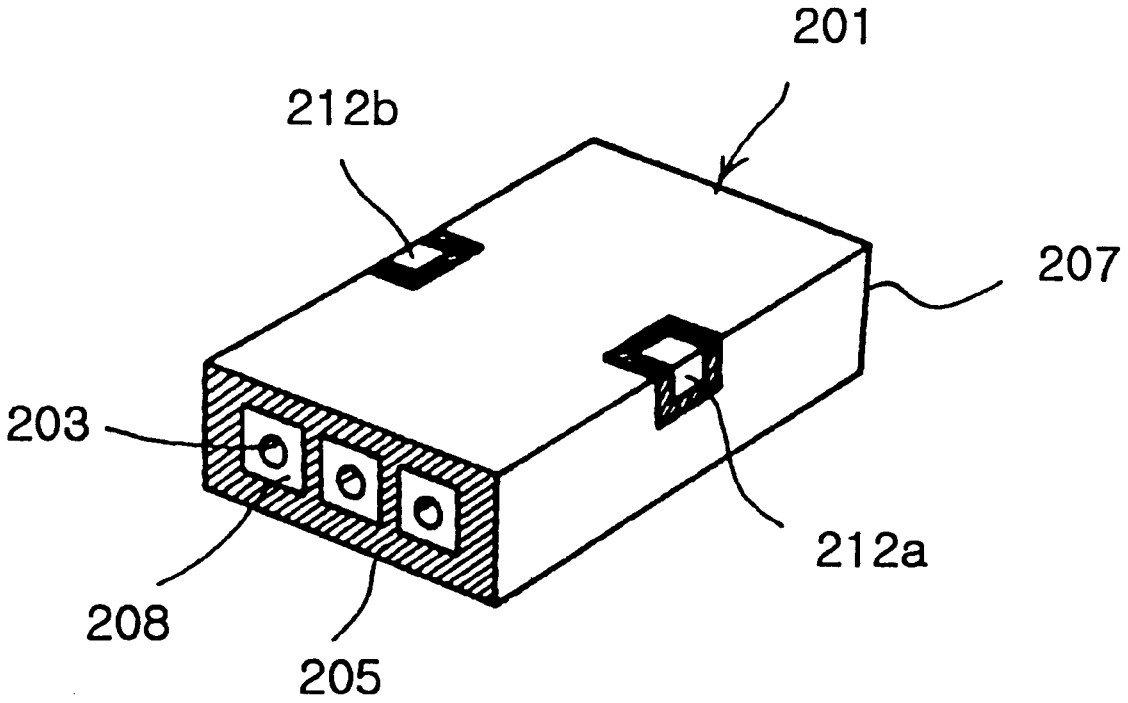
FIG. 7 is a perspective view of another embodiment of the unitized dielectric filter according to the present invention.

FIG. 7 is a perspective view of another embodiment of the unitized dielectric filter according to the present invention. FIG. 8 illustrates the second face of the filter of FIG. 7. The dielectric block 201 of FIG. 7 is same as that of FIG. 3 except that the number of resonance holes 203 is reduced. Therefore, description on the same structures will be skipped.

Figure 8A:
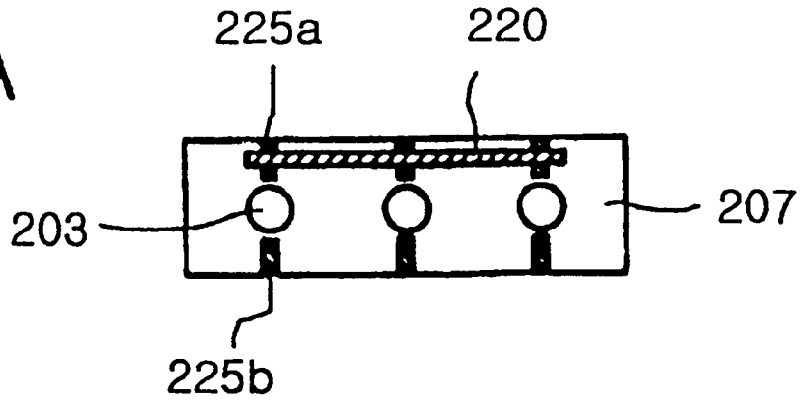
FIG. 8 illustrates the second face of the filter of FIG. 7.
Figure 8B:
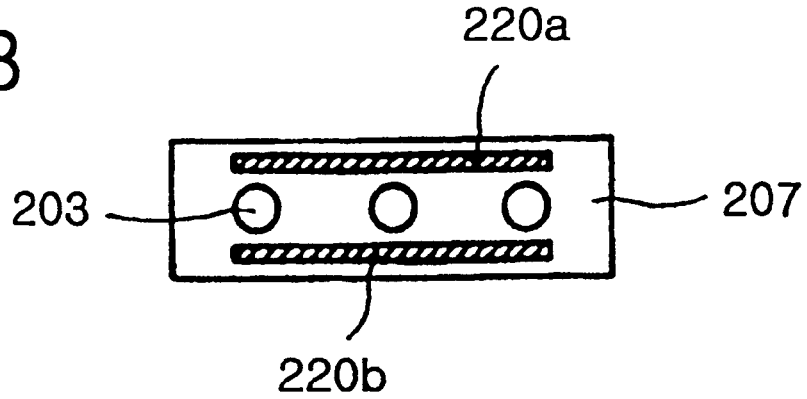
Figure 8C:
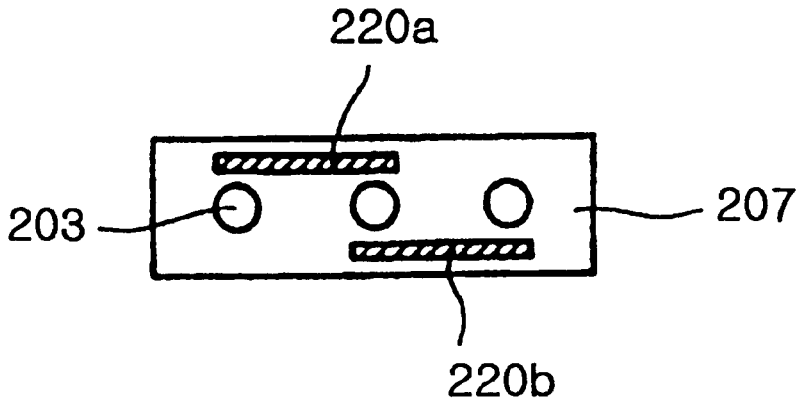

FIGS. 8A to 8C illustrate examples of open areas which are formed on a second face 207 of the dielectric block 201. Referring to FIG. 8A, a first open area 220 is formed on the second face 207 in parallel with the arrangement direction of the resonance holes 203 above the holes. Further, second open areas 225*a* and 225*b* are formed perpendicularly to the first open area 220. The second open region 225*a* may be or may not be integral with the first open area 220. The second open areas 225*a* and 225*b* are for adjusting the resonance frequency, and by adjusting their lengths, the loading capacitance can be adjusted, thereby making it possible to adjust the resonance frequency.

The first open area 220 and the second open areas 225*a* and 225*b* are formed simultaneously with the ground electrode by spreading a conductive material when the ground electrode of the second face 207 is formed, in a state with certain areas shielded by a mask.

Referring to FIG. 8*a*, although the first open area 220 and the second open areas 235*a* and 235*b* are simultaneously formed, this is for the sake of describing convenience. It is possible to form only the first open area 220 or the second open areas 225*a* and 225*b*. Further, there is no need for limiting the size, the shape and the number of the resonance frequency adjusting second open areas 225*a* and 225*b*.

Referring to FIG. 8B, open areas 220*a* and 220*b* are formed respectively above and below the resonance holes 203 in parallel with the arrangement direction of the holes 203. Referring to FIG. 8*c*, open areas 220*a* and 220*b* are formed respectively above and below the resonance holes 203 in such a manner that the open area 220*a* is formed above the left and middle holes 203, and the open area 220*b* is formed below the middle and right holes 203. Although it is not illustrated in FIGS. 8*b* and 8*c*, it is possible to form the resonance frequency adjusting open areas like in FIG. 8A.

FIGS. 8B and 8C are for obtaining the same effects as that of FIG. 8A, and the only difference between them is the difference in magnitude of the coupling inductance.

Figure 10:
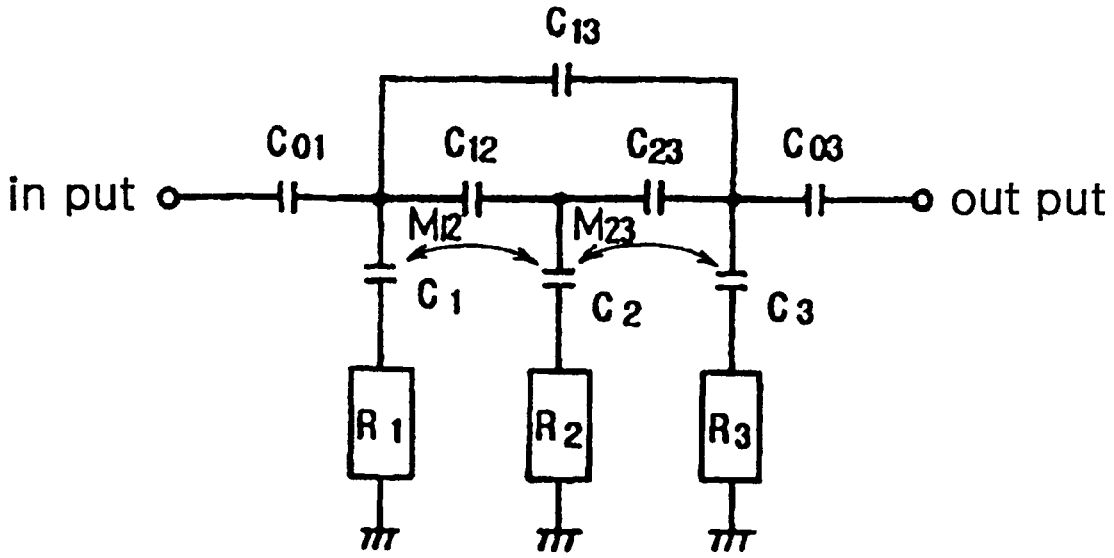
FIG. 10 is an equivalent circuit diagram for the unitized dielectric filter of FIG. 7.

FIG. 10 is an equivalent circuit diagram for the unitized dielectric filter of FIG. 7. Even when the shapes of the open areas 220 is different from each other, the equivalent circuit has the same constitution, and therefore, it will be described based on the examples of FIGS. 8A to 8C.

The constitution of the circuit of FIG. 10 and that of FIG. 6 are same except the capacitance $C_{13}$ and the inductance $M_{13}$. Therefore the overall descriptions of it will be skipped, but only the capacitance $C_{13}$ will be described. The first open area 220 of FIG. 8*a* forms not only coupling inductances $M_{12}$ and $M_{23}$ with the adjacent resonators, but also cross coupling inductances $M_{13}$ with non-adjacent resonators. These cross coupling inductances $M_{13}$ together with the coupling inductances $M_{12}$ and $M_{23}$ cause the total inductance of the dielectric filter to be increased. Therefore, the overall inductance of the dielectric filter can be controlled by controlling the size of the first open area 220, and therefore, the characteristics of the dielectric filter can be easily controlled. In the case where four or more resonators are provided, the cross coupling inductances $M_{13}$ are formed with all the non-adjacent resonators other than the adjacent resonators, and therefore, more cross coupling inductances can be obtained.

The second open area of FIG. 8A increases the loading capacitances C1, C2 and C3 of the resonators R1, R2 and R3. They play the role of lowering the resonance frequency of the resonator related to a given through-hole. Therefore, the resonance frequency can be adjusted by controlling the size of the second open area 235.

The magnitudes of the coupling inductances $M_{12}$ and $M_{23}$ and the cross coupling inductances $M_{13}$ increase proportionally to the widths and lengths of the first open areas 220, while the resonance frequency is lowered proportionally to the increase of the areas of the second open areas 225.

Figure 9A:
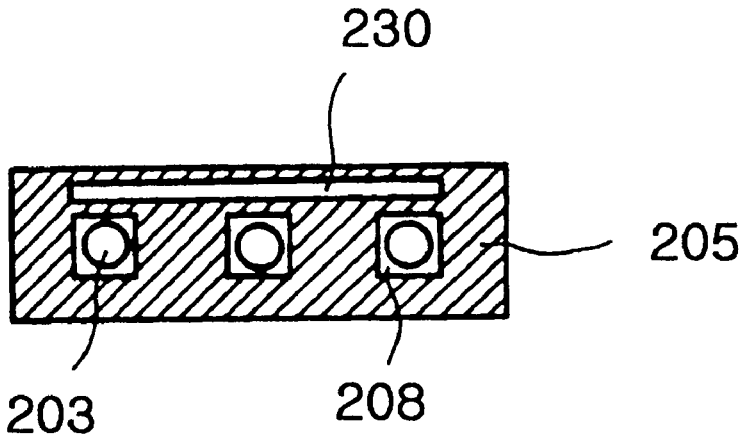
FIG. 9 illustrates the first face of the filter of FIG. 7.
Figure 9B:
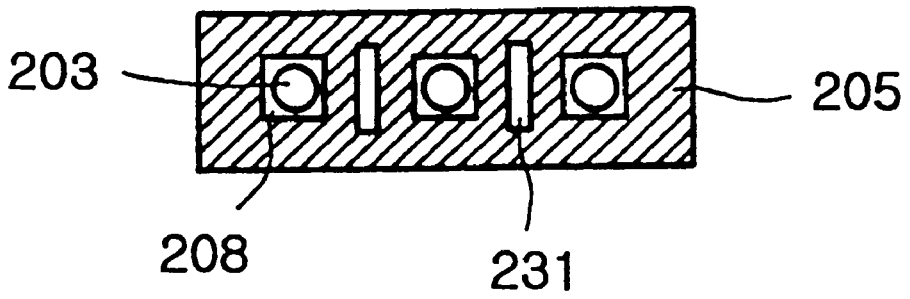
Figure 9C:
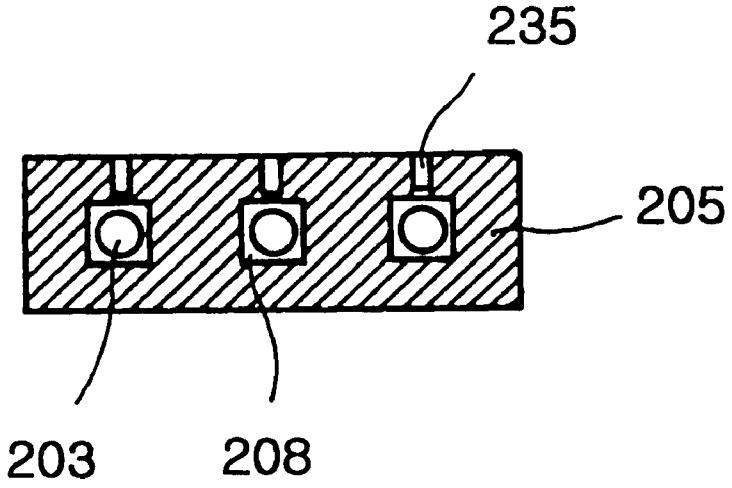

FIG. 9 illustrates the structure of the first face of the dielectric block, and this first face has the same structure as that of the first face of FIG. 5. Referring to FIGS. 9A and 9B, conductor patterns 230 and 231 are for forming coupling capacitances with adjacent resonators. Referring to FIG. 9C, a conductor pattern 235 is for adjusting the resonance frequency. That is, the resonance frequency of the resonator can be adjusted by adjusting the area of the conductor pattern 235 and by adjusting the gap between the conductor pattern 235 and the end of the resonance hole 203. Here also, the shape and position of the conductor pattern are not limited to those illustrated in the drawings, but may be provided differently.

Figure 11:
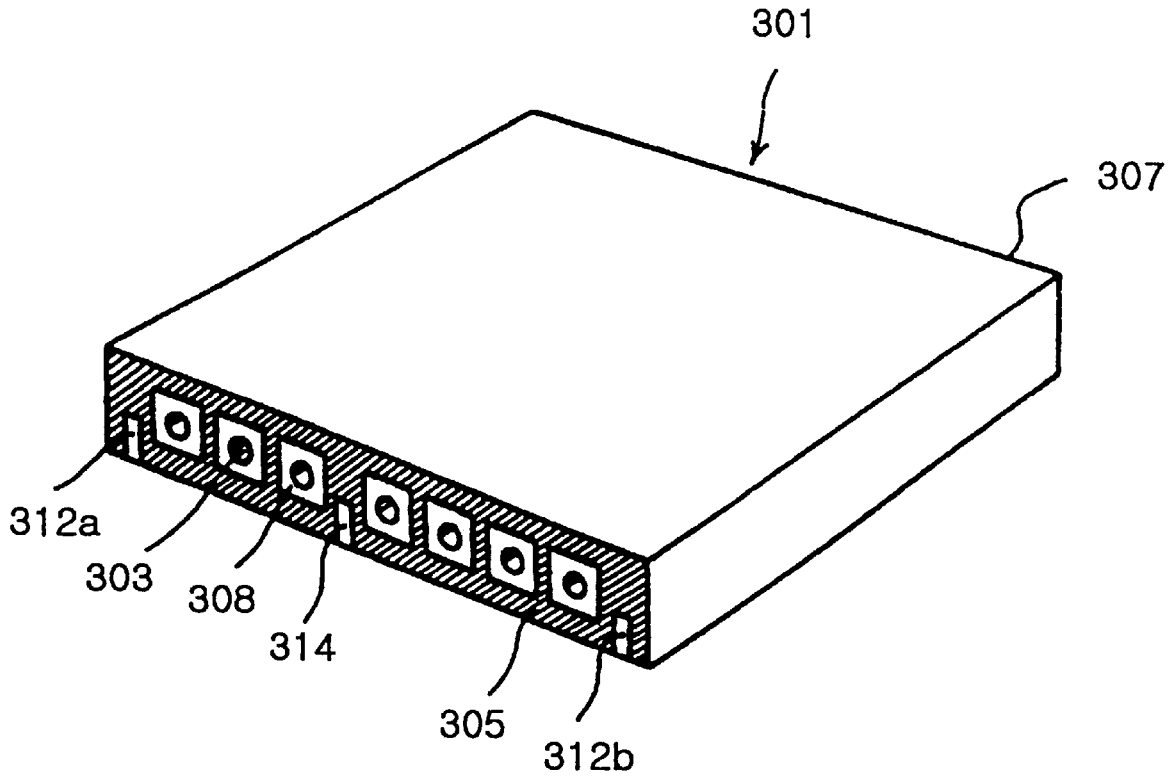
FIG. 11 is a perspective view of the duplex dielectric filter in still another embodiment of the present invention.

FIG. 11 is a perspective view of the duplex dielectric filter in still another embodiment of the present invention. FIG. 12 illustrates the second face of the filter of FIG. 11. FIG. 13 illustrates the first face of the filter of FIG. 11.

As shown in FIG. 11, the duplex dielectric filter includes: oppositely facing first and second faces 305 and 307, and an approximately hexahedral dielectric block 301. Through the dielectric block 301, there pass a plurality of resonance holes 303 in parallel to each other from the first face 305 to the second face 307. Ground electrodes are formed on the second face 307 and on the side faces between the first face 305 and the second face 307. Internal electrodes are formed on the insides of the resonance holes 303, thereby forming resonators. Further, the first face 305 is provided with open areas on which a conductive material is not spread.

Around the resonance holes 303 of the first face 305, there 308 are formed conductor pattern which are respectively connected to the internal electrodes of the resonance holes 303, thereby forming loading capacitances with the ground electrodes of the dielectric block 301, and forming coupling capacitances with the conductor patterns 308. Further, the first face 305 is provided with transmitting and receiving terminals 312*a* and 312*b*, and an antenna terminal 314.

The duplex dielectric filter includes two filtering regions. If a first filtering region filters reception signals from the antenna terminal, a second filtering region filters transmission signals transmitted through the antenna terminal. Generally, in the dielectric filter, the receiving and transmitting regions need not be specially distinguished. In duplex dielectric filters having the same constitutions, the receiving region and the transmitting region may be differently provided depending on the products. In the present invention, the receiving region and the transmitting region are illustrated in specific forms, but this should not limit the scope of the present invention.

In the dielectric filter of FIG. 11, the three resonance holes disposed at the left side of the antenna terminal 314 are the reception filtering region for receiving RF signals from the external, while the four resonance holes disposed at the right side of the antenna terminal 314 are the transmission filtering region for outputting a radio frequency. The reception filtering region has the pass characteristic for the reception frequency, while blocking the transmission frequency. On the other hand, the transmission filtering region has a pass characteristic for the transmission frequency, while blocking the reception frequency.

Figure 12A:
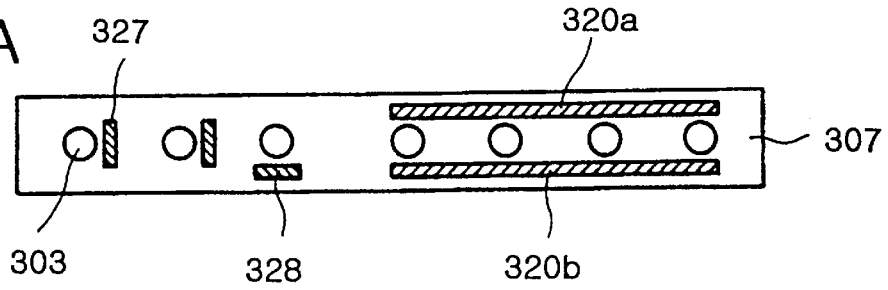
FIG. 12 illustrates the second face of the filter of FIG.

FIGS. 12A to 12D illustrate examples of the open areas of the second face 307. As shown in FIG. 12A, between the resonance holes 303 of the reception filtering region, there are formed first open areas 327 of certain width and length, on which a conductive material is not spread. Meanwhile below the rightmost resonance hole 303 of the reception filtering region, there is formed a second open area 328. The first open areas 327 and the second open area 328 are disposed keeping a certain distance from the resonance holes 303, so as to be electrically isolated from the holes 303. Here, the second open area 328 may be disposed above or below the resonance hole 303.

Third open areas 320*a* and 320*b* are formed above and below the resonance holes 303 of the transmission filtering region respectively in parallel with the arrangement direction of the holes 303, keeping a certain distance from the holes 303. The positions of the third open areas 320*a* and 320*b* are not limited to the second face 307, but they may be disposed either on the second face or on the side faces. Alternatively the third open area may be disposed above or below the holes 303, and in addition to above and below the holes 303.

Figure 14:
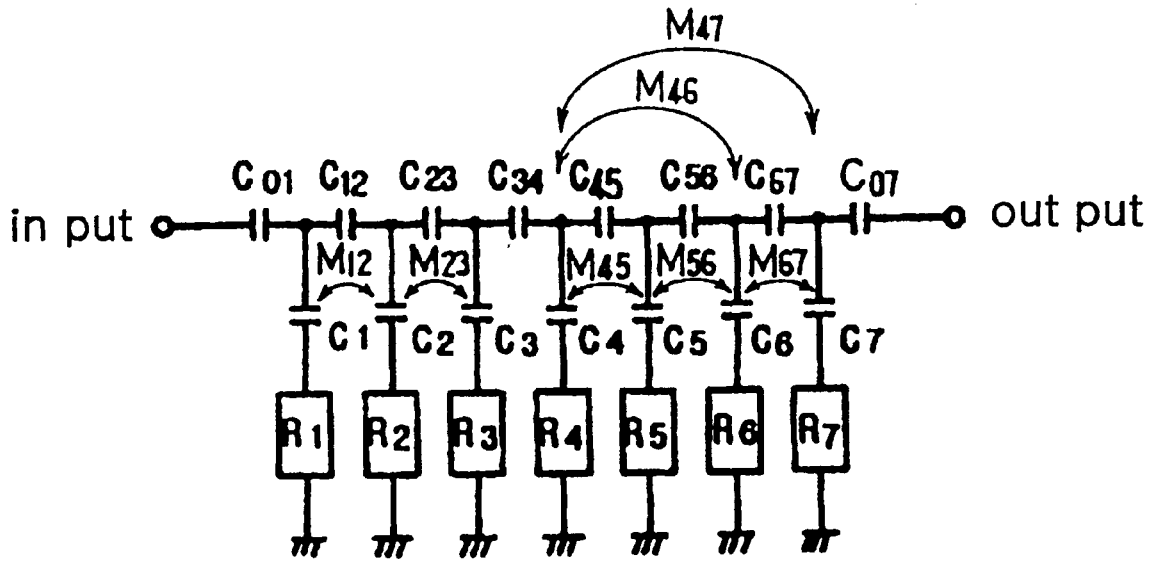
FIG. 14 is an equivalent circuit diagram for the duplex dielectric filter of FIG. 11.

FIG. 14 is an equivalent circuit diagram for the duplex dielectric filter of FIG. 11. Referring to this drawing, the duplex dielectric filter of FIG. 12A will be described.

Referring to the drawing, the first open areas 327 between the resonance holes 303 of the reception filtering region are for increasing coupling capacitances $C_{12}$ and $C_{23}$ with the resonators of the reception filtering region. As their areas are increased, so much the coupling capacitances are increased. Thus the desired filter characteristics can be obtained by adjusting the coupling capacitances $C_{12}$ and $C_{23}$ through the adjustment of the areas of the first open areas 327. Further, the resonance frequency can be adjusted by varying the area of the second open area 328. Here, as the area of the second open area 328 increases, so much the resonance frequency is lowered. The formation of the second open area 328 gives an effect same as an expansion of the conductor pattern 308 of the first face 305, which is connected to the internal electrode of the resonance hole 303 of the reception filtering region. Ultimately it extends the length of the resonator, thereby lowering the resonance frequency.

Like the dielectric filters of FIGS. 3 and 7, the third open areas 320*a* and 320*b* of the transmission filtering region form not only coupling inductances $M_{45}$, $M_{46}$ and $M_{47}$ with the adjacent resonators, but also cross coupling inductances $M_{46}$ and $M_{47}$. In FIG. 13, a cross coupling inductance for a particular resonator R4 is illustrated, but the cross coupling inductances exist for all the resonators R4, R5, R6 and R7, and therefore,, the total coupling inductance at the transmitting terminal is very much increased. Here, as the areas of the third open areas 320*a* and 320*b* are increased, and as the gaps between the third open areas 320*a* and 320*b* and the resonance holes are narrowed, so much the coupling inductance is increased. Therefore, like in the reception filtering region, the desired characteristics can be obtained by adjusting the areas of the third open areas 320*a* and 320*b*, and by adjusting the mentioned gaps.

Figure 12B:
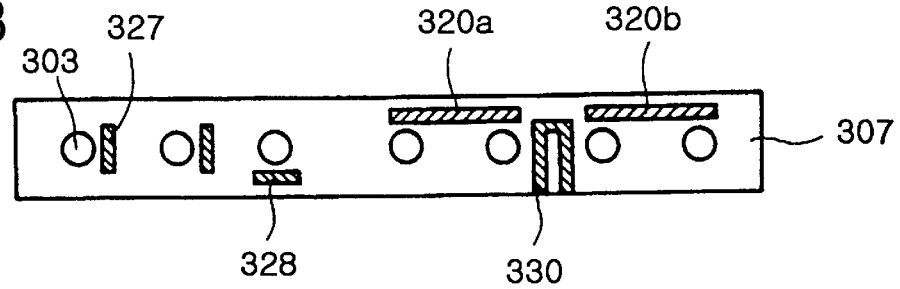

Referring to FIG. 12B, there is illustrated another example of the open areas. Here, the third open areas 320*a* and 320*b* are disposed above the resonance holes 303 in two pieces in parallel with the arrangement direction of the resonance holes 303, while there is formed a fourth open area 330 between the resonance holes 303. In this manner, the coupling capacitance for resonators adjacent to the fourth open area 330 is very much increased.

Figure 12C:
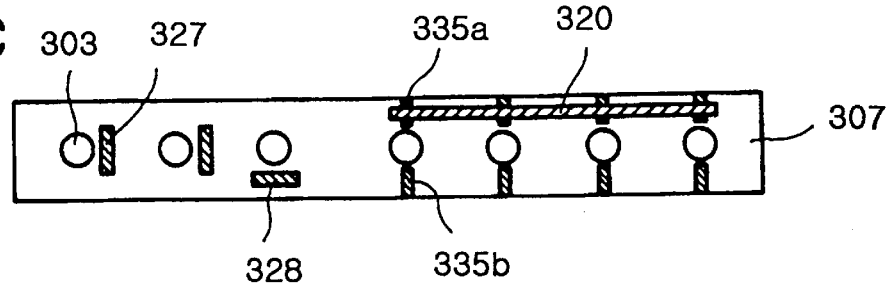

Referring to FIG. 12C, the third open area 320 is formed in one piece above the resonance holes 303 of the transmission filtering region in parallel with the arrangement direction of the resonance holes 303 of the same region. Further, like in FIG. 8*a*, fifth open areas 335*a* and 335*b* are respectively formed above and below each of the resonance holes 303 of the transmission filtering region. The fifth open areas 325*a* and 325*b* are for finely adjusting the resonance frequency, and they are formed simultaneously when the ground electrode is formed by spreading a conductive material by using a mask like the first to fourth open areas. The resonance frequency can be finely adjusted by adjusting the size of the pattern and the gap between the end of the resonance hole and the pattern. Like in the other examples, the resonance frequency adjusting fifth open areas 325*a* and 325*b* can be formed singly on the second face, or above or below the holes 303. Further, they can be formed at the sides of the resonance holes 303. That is, the positions of the fifth open areas are not limited to particular positions. Further, as shown in the drawing, the fifth open areas 325*a* and 325*b* may be connected to the ground electrodes of the sides of the dielectric block, or can be isolated from them.

Figure 12D:
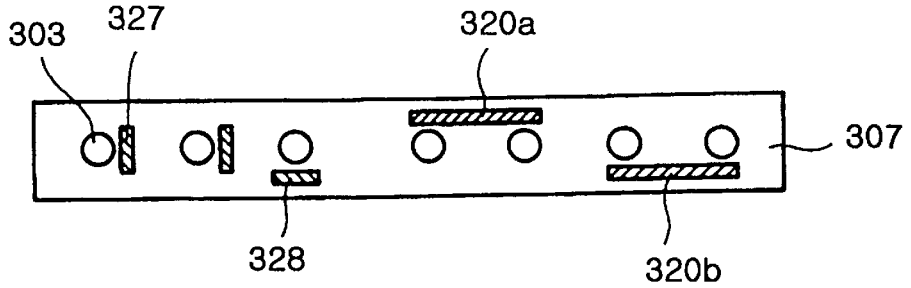

Referring to FIG. 12D, the third open area 320*a* is disposed above the two leftmost resonance holes 303, while the third open area 320*b* is disposed below the two rightmost resonance holes 303 in parallel with the arrangement direction of the holes 303. In this case, the cross coupling inductance is not present, but the coupling inductance is increased for the adjacent resonance holes 303, thereby making it possible to obtain the desired characteristics. Further, although there is not illustrated in the drawings, in FIGS. 12B and 12D, in addition to the two pieces of the open areas, an open area covering three resonance holes 303 may be provided, so that coupling inductances with the adjacent resonators and cross coupling inductances with non-adjacent resonators can be obtained.

Figure 13A:
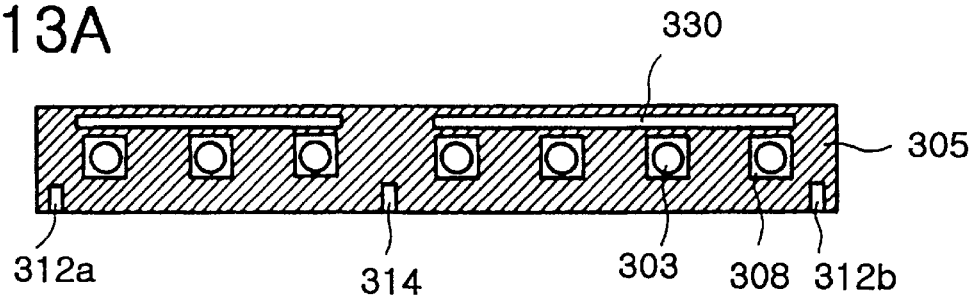
FIG. 13 illustrates the first face of the filter of FIG. 11.
Figure 13B:
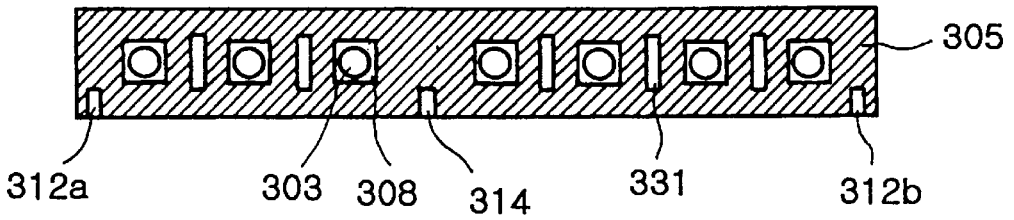
Figure 13C:
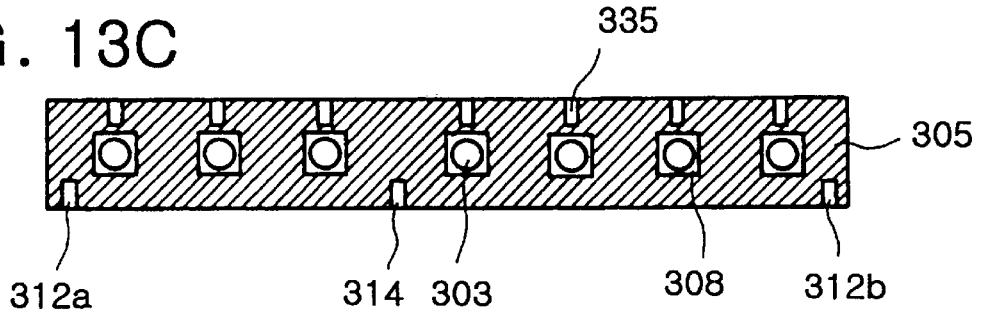

Referring to FIG. 13, the structures of the first face of the dielectric block are same as those of FIGS. 5 and 9, except that the conductor patterns are form around and near every resonance hole 303 of the reception filtering region and the transmission filtering region. Therefore, the structures of the first face will not be described. The respective examples illustrated in FIGS. 13A to 13B can be combined with the structures of FIGS. 12A to 12D, and thus, diversified filter structures can be formed.

The above described open areas are not restricted to particular positions, particular shapes and particular sizes. The above described examples are only for making the present invention understood, and therefore, the specific examples should not limit the scope of the present invention. Further, the number of the resonance holes is not restricted.

According to the present invention as described above, the dielectric block with ground electrodes formed thereon is provided with open areas (having no electrode functions) to add capacitances and inductances. Therefore, the size of the conductor patterns which are formed around the resonance holes can be reduced, but the printing errors due to the reduction of the size do not occur. Accordingly, The dielectric filter can be formed in a miniature and light weight form. Further, through an adjustment of the size of the open areas which are formed on the rear face, the magnitudes of the capacitance and the inductance can be controlled, thereby obtaining the desired filter characteristics. Further, by providing resonance frequency adjusting open areas, the resonance frequency can be finely adjusted.

What is claimed is:

1. A dielectric filter comprising:

a dielectric block having first and second faces and side faces between said first and second faces, said second face and said side faces being coated with a conductive material;

a plurality of resonance holes passing through said first and second faces in parallel with each other, with insides of said holes being coated with a conductive material to form internal electrodes;

input and output pads for respectively receiving and transmitting signals, each of them including an isolated electrode and the conductive material of said side faces of said dielectric block, for forming an electromagnetic coupling with a respective resonance hole;

at least a first conductor pattern formed on said first face of said dielectric block to be connected to said internal electrodes of said resonance holes so as to form a loading capacitance and to form an electromagnetic coupling with adjacent resonators; and at least a first open area without being coated with a conductive material, said first open area being disposed in parallel with the arrangement direction of said resonance holes on said second face of said dielectric block to form a coupling inductance with adjacent resonators and to form a cross coupling inductance with nonadjacent resonators.

2. The dielectric filter as claimed in claim 1, wherein said first open area is formed by shielding relevant areas when said second face and side faces are spread with a conductive material.

3. The dielectric filter as claimed in claim 1, further comprising at least a second conductor pattern formed on said first face of said dielectric block in parallel with an arrangement direction of said resonance holes and keeping a certain distance from said holes so as to form an electromagnetic coupling with adjacent resonators.

4. The dielectric filter as claimed in claim 1, further comprising at least a third conductor pattern formed on said first face of said dielectric block between said resonance holes to form an electromagnetic coupling with adjacent resonators.

5. The dielectric filter as claimed in claim 4, wherein said third conductor pattern is connected to a material spread on said side faces of said dielectric block.

6. The dielectric filter as claimed in claim 1, further comprising a fourth conductor pattern formed on said first face of said dielectric block to extend from the conductive material of said side faces of said dielectric block toward ends of said resonance holes so as to make it possible to adjust resonance frequencies.

7. The dielectric filter as claimed in claim 6, wherein the resonance frequency is adjusted by adjusting areas of said fourth conductor patterns and gaps between said resonance holes and said fourth conductor patterns.

8. The dielectric filter as claimed in claim 1, wherein said first open area is disposed above or below said resonance holes.

9. The dielectric filter as claimed in claim 1, further comprising at least a second open area of a certain size formed between said resonance holes on said second face, without being spread with a conductive material, to form a coupling capacitance with an adjacent resonator.

10. The dielectric filter as claimed in claim 1, further comprising a third open area formed on said second face, keeping a certain distance from ends of said resonance holes, to make it possible to adjust the resonance frequency of resonators.

11. The dielectric filter as claimed in claim 10, wherein said third open area is formed between ends of said resonance holes and a side face of said dielectric block.

12. A duplex dielectric filter comprising:

a dielectric block having first and second faces and side faces between said first and second faces, said second face and said side faces being coated with a conductive material;

a receiving region for filtering a receiving signal, said receiving region including at least one resonator having a plurality of resonance holes passing through said first and second faces of said dielectric block in parallel with each other, with insides of said holes being coated with a conductive material to form internal electrodes;

a transmitting region for filtering a transmitting signal, said transmitting region including at least one resonator having a plurality of resonance holes passing through said first and second faces of said dielectric block in parallel with each other, with insides of said holes being coated with a conductive material to form internal electrodes;

input and output pads, each of them including an isolated electrode and the conductive material of said side faces of said dielectric block, for forming an electromagnetic coupling with a respective resonance hole;

an antenna pad having an isolated area isolated from the conductive material, and disposed between said receiving and transmitting regions to form an electromagnetic coupling with said resonators;

at least a first conductor pattern formed on said first face of said dielectric block to be connected to said internal electrodes of said resonance holes so as to form a loading capacitance and to form an electromagnetic coupling with adjacent resonators; and at least a first open area without being coated with a conductive material, said first open area being disposed in parallel with the arrangement direction of said resonance holes on said receiving region of said second face of said dielectric block to form a coupling inductance with adjacent resonators and to form a cross coupling inductance with non-adjacent resonators.

13. The duplex dielectric filter as claimed in claim 12, wherein said first open area is formed by shielding relevant areas when said second face and side faces are spread with a conductive material.

14. The duplex dielectric filter as claimed in claim 12, further comprising at least a second conductor pattern formed on said first face of said dielectric block in parallel with an arrangement direction of said resonance holes and keeping a certain distance from said holes so as to form an electromagnetic coupling with adjacent resonators.

15. The duplex dielectric filter as claimed in claim 12, further comprising at least a third conductor pattern formed on said first face of said dielectric block between said resonance holes to form an electromagnetic coupling with adjacent resonators.

16. The duplex dielectric filter as claimed in claim 15, wherein said third conductor pattern is connected to the conductive material spread on said side faces of said dielectric block.

17. The duplex dielectric filter as claimed in claim 12, further comprising a fourth conductor pattern formed on said first face of said dielectric block to extend from the conductive material of said side faces of said dielectric block toward ends of said resonance holes so as to make it possible to adjust resonance frequencies.

18. The duplex dielectric filter as claimed in claim 17, wherein the resonance frequency is adjusted by adjusting areas of said fourth conductor patterns and gaps between said resonance holes and said fourth conductor patterns.

19. The duplex dielectric filter as claimed in claim 12, wherein said first open area is disposed above or below said resonance holes.

20. The duplex dielectric filter as claimed in claim 12, further comprising at least a second open area of a certain size disposed between said resonance holes on said second face, without being spread with a conductive material, to form coupling capacitances with adjacent resonators.

21. The duplex dielectric filter as claimed in claim 12, further comprising a third open area formed on said second face, keeping a certain distance from ends of said resonance holes, to make it possible to adjust the resonance frequency of resonators.

22. The duplex dielectric filter as claimed in claim 21, wherein said third open area is formed between ends of said resonance holes and a side face of said dielectric block.

23. A dielectric filter comprising:

a dielectric block having first and second faces and side faces between said first and second faces, said second face and said side faces being coated with a conductive material;

a plurality of resonance holes passing through said first and second faces in parallel with each other, with insides of said holes being coated with a conductive material to form internal electrodes;

input and output pads for respectively receiving and transmitting signals, each of them including an isolated electrode and the conductive material of said side faces of said dielectric block, for forming an electromagnetic coupling with a respective resonance hole;

at least a first conductor pattern formed on said first face of said dielectric block to be connected to said internal electrodes of said resonance holes so as to form a loading capacitance and to form an electromagnetic coupling with adjacent resonators;

at least a second conductor pattern formed on said first face of said dielectric block in parallel with an arrangement direction of said resonance holes and keeping a certain distance from said holes so as to form an electromagnetic coupling with adjacent resonators; and at least an open area without being coated with a conductive material, said open area being disposed in parallel with the arrangement direction of said resonance holes on said second face of said dielectric block to form a coupling inductance with adjacent resonators and to form a cross coupling inductance with non-adjacent resonators.

24. A dielectric filter comprising:

a dielectric block having first and second faces and side faces between said first and second faces, said second face and said side faces being coated with a conductive material;

a plurality of resonance holes passing through said first and second faces in parallel with each other, with insides of said holes being coated with a conductive material to form infrared electrodes;

input and output pads for respectively receiving and transmitting signals, each of them including an isolated electrode and the conductive material of said side faces of said dielectric block, for forming an electromagnetic coupling with a respective resonance hole;

at least a first conductor pattern formed on said first face of said dielectric block to be connected to said internal electrodes of said resonance holes so as to form a loading capacitance and to form an electromagnetic coupling with adjacent resonators;

a second conductor pattern formed on said first face of said dielectric block to extend from the conductive material of said side faces of said dielectric block toward ends of said resonance holes so as to make it possible to adjust resonance frequencies; and at least an open area without being coated with a conductive material, said open area being disposed in parallel with the arrangement direction of said resonance holes on said second face of said dielectric block to form a coupling inductance with adjacent resonators and to form a cross coupling inductance with non-adjacent resonators.

25. A dielectric filter comprising:

a dielectric block having first and second faces and side faces between said first and second faces, said second face and said side faces being coated with a conductive material;

a plurality of resonance holes passing through said first and second faces in parallel with each other, with insides of said holes being coated with a conductive material to form internal electrodes;

input and output pads for respectively receiving and transmitting signals, each of them including an isolated electrode and the conductive material of said side faces of said dielectric block, for forming an electromagnetic coupling with a respective resonance hole;

at least a conductor pattern formed on said first face of said dielectric block to be connected to said internal electrodes of said resonance holes so as to form a loading capacitance and to form an electromagnetic coupling with adjacent resonators;

at least a first open area without being coated with a conductive material, said first open area being disposed in parallel with the arrangement direction of said resonance holes on said second face of said dielectric block to form a coupling inductance with adjacent resonators and to form a cross coupling inductance with non-adjacent resonators; and at least a second open area of a certain size formed between said resonance holes on said second face, without being spread with a conductive material, to form a coupling capacitance with an adjacent resonator.

26. A dielectric filter comprising:

a dielectric block having first and second faces and side faces between said first and second faces, said second face and said side faces being coated with a conductive material;

a plurality of resonance holes passing through said first and second faces in parallel with each other, with insides of said holes being coated with a conductive material to form internal electrodes;

input and output pads for respectively receiving and transmitting signal, each of them including an isolated electrode and the conductive material of said side faces of said dielectric block, for forming an electromagnetic coupling with a respective resonance hole;

at least a conductor pattern formed on said first face of said dielectric block to be connected to said internal electrodes of said resonance holes so as to form a loading capacitance and to form an electromagnetic coupling with adjacent resonators;

at least a first open area without being coated with a conductive material, said first open area being disposed in parallel with the arrangement direction of said resonance holes on said second face of said dielectric block to form a coupling inductance with adjacent resonators and to form a cross coupling inductance with non-adjacent resonators; and a second open area formed between the end portion of said resonant hole and the side face on said second face, keeping a certain distance from ends of said resonance holes, to make it possible to adjust the resonance frequency of resonators.

27. A duplex dielectric filter comprising:

a dielectric block having first and second faces and side faces between said first and second faces, said second face and said side faces being coated with a conductive material;

a receiving region for filtering the receiving signals, said receiving region including at least one resonator having a plurality of resonance holes passing through said first and second faces of said dielectric block in parallel with each other, with insides of said holes being coated with a conductive material to form internal electrodes;

a transmitting region for filtering the transmitting signals, said transmitting region including at least one resonator having a plurality of resonance holes passing through said first and second faces of said dielectric block in parallel with each other, with insides of said holes being coated with a conductive material to form internal electrodes;

input and output pads, each of them including an isolated electrode and the conductive material of said side faces of said dielectric block, for forming an electromagnetic coupling with a respective resonance hole;

an antenna pad having an isolated area isolated from the conductive material, and disposed between said receiving and transmitting regions to form an electromagnetic coupling with resonators;

at least a first conductor pattern formed on said first face of said dielectric block to be connected to said internal electrodes of said resonance holes so as to form a loading capacitance and to form an electromagnetic coupling with adjacent resonators;

at least a second conductor pattern formed on said first face of said dielectric block in parallel with an arrangement direction of said resonance holes and keeping a certain distance from said holes so as to form an electromagnetic coupling with adjacent resonators; and at least an open area without being coated with a conductive material, said open area being disposed in parallel with the arrangement direction of said resonance holes on said receiving region of said second face of said dielectric block to form a coupling inductance with adjacent resonators and to form cross coupling inductance with non-adjacent resonators.

28. A duplex dielectric filter comprising:

a dielectric block having first and second faces and side faces between said first and second faces, said second face and said side faces being coated with a conductive material;

a receiving region for filtering the receiving signals, said receiving region including at least one resonator having a plurality of resonance holes passing through said first and second faces of said dielectric block in parallel with each other, with insides of said holes being coated with a conductive material to form internal electrodes;

a transmitting region for filtering the transmitting signals, said transmitting region including at least one resonator having a plurality of resonance holes passing through said first and second faces of said dielectric block in parallel with each other, with insides of said holes being coated with a conductive material to form internal electrodes;

input and output pads, each of them including an isolated electrode and the conductive material of said side faces of said dielectric block, for forming an electromagnetic coupling with a respective resonance hole;

an antenna pad having an isolated area isolated from the conductive material, and disposed between said receiving and transmitting regions to form an electromagnetic coupling with resonators;

at least a first conductor pattern formed on said first face of said dielectric block to be connected to said internal electrodes of said resonance holes so as to form a loading capacitance and to form an electromagnetic coupling with adjacent resonators;

a second conductor pattern formed on said first face of said dielectric block to extend from the conductive material of said side faces of said dielectric block toward ends of said resonance holes so as to make it possible to adjust resonance frequencies; and at least an open area without being coated with a conductive material, said open area being disposed in parallel with the arrangement direction of said resonance holes on said receiving region of said second face of said dielectric block to form a coupling inductance s with adjacent resonators and to form a cross coupling inductance with non-adjacent resonators.

29. A duplex dielectric filter comprising:

a dielectric block having first and second faces and side faces between said first and second faces, said second face and said side faces being coated with a conductive material;

a receiving region for filtering the receiving signals, said receiving region including at least one resonator having a plurality of resonance holes passing through said first and second faces of said dielectric block in parallel with each other, with insides of said holes being coated with a conductive material to form internal electrodes;

a transmitting region for filtering the transmitting signals, said transmitting region including at least one resonator having a plurality of resonance holes passing through said first and second faces of said dielectric block in parallel with each other, with insides of said holes being coated with a conductive material to form internal electrodes;

input and output pads, each of them including an isolated electrode and the conductive material of said side faces of said dielectric block, for forming an electromagnetic coupling with a respective resonance hole;

an antenna pad having an isolated area isolated from the conductive material, and disposed between said receiving and transmitting regions to form an electromagnetic coupling with resonators;

at least a conductor pattern formed on said first face of said dielectric block to be connected to internal electrodes of resonance holes so as to form a loading capacitance and to form an electromagnetic coupling with adjacent resonators;

at least a first open area without being coated with a conductive material, said first open area being disposed in parallel with the arrangement direction of said resonance holes on said receiving region of said second face of said dielectric block to form a coupling inductance with adjacent resonators and to form a cross coupling inductance with non-adjacent resonators; and at least a second open area of a certain size disposed between said resonance holes on said second face, without being spread with a conductive material, to form coupling capacitances with adjacent resonators.

30. A duplex dielectric filter comprising:

a dielectric block having first and second faces and side faces between said first and second faces, said second face and said side faces being coated with a conductive material;

a receiving region for filtering the receiving signals, said receiving region including at least one resonator having a plurality of resonance holes passing through said first and second faces of said dielectric block in parallel with each other, with insides of said holes being coated with a conductive material to form internal electrodes;

a transmitting region for filtering the transmitting signals, said transmitting region including at least one resonator having a plurality of resonance holes passing through said first and second faces of said dielectric block in parallel with each other, with insides of said holes being coat ed with a conductive material to form internal electrodes;

input and output pads, each of them including an isolated electrode and the conductive material of said side faces of said dielectric block, for forming an electromagnetic coupling with a respective resonance hole;

an antenna pad having an isolated area isolated from the conductive material, and disposed between said receiving and transmitting regions to form an electromagnetic coupling with resonators;

at least a conductor pattern formed on said first face of said dielectric block to be connected to said internal electrodes of said resonance holes so as to form a loading capacitance and to form an electromagnetic coupling with adjacent resonators;

at least a first open area without being coated with a conductive material, said first open area being disposed in parallel with the arrangement direction of said resonance holes on said receiving region of said second face of said dielectric block to form a coupling inductance with adjacent resonators and to form a cross coupling inductance with non-adjacent resonators; and a second open area formed on said second face, keeping a certain distance from ends of said resonance holes, to make it possible to adjust the resonance freguency of resonators.

* * * * *